United States Patent [19]

Burk

[11] Patent Number: 4,821,622

[45] Date of Patent: Apr. 18, 1989

[54] EXTENSION AND RETRACTION SEQUENCING CIRCUIT

[75] Inventor: Ronnie F. Burk, Waterloo, Iowa

[73] Assignee: Deere & Company, Moline, Ill.

[21] Appl. No.: 945,279

[22] Filed: Dec. 22, 1986

[51] Int. Cl.[4] ..... F15B 13/04

[52] U.S. Cl. ..... 91/29; 91/31; 91/189 R; 91/517; 137/493; 137/513.3

[58] Field of Search ..... 91/24, 29, 31, 193, 91/189 R, 512, 517, 518; 137/493, 513.3, 599.2, 493

[56] References Cited

U.S. PATENT DOCUMENTS

| | | | |
|---|---|---|---|
| 1,994,974 | 3/1955 | Wiedmann | 137/493 |
| 2,054,296 | 9/1936 | Merrill | 91/193 |
| 2,634,947 | 4/1953 | Gardner | 137/599.2 |
| 2,698,517 | 1/1955 | Witt | 91/193 |
| 2,989,072 | 6/1961 | Banker | 137/493 |
| 3,067,770 | 12/1962 | Fancher | 137/493 |
| 3,152,606 | 10/1964 | Vedder et al. | 137/493.2 |
| 3,871,266 | 3/1975 | Schwab et al. | 91/517 |
| 3,967,534 | 7/1976 | Cryder et al. | 91/189 R |
| 3,978,879 | 9/1976 | Termansen et al. | 137/493 |
| 3,990,349 | 11/1976 | Valantin | 91/178 |
| 4,112,822 | 9/1978 | Murata | 91/29 |
| 4,145,957 | 3/1979 | McClocklin | 91/508 |
| 4,285,268 | 8/1981 | Deckler | 91/517 |
| 4,461,449 | 7/1984 | Turner | 137/493 |

FOREIGN PATENT DOCUMENTS

| | | | |
|---|---|---|---|
| 388901 | 1/1924 | Fed. Rep. of Germany | 137/493 |
| 758908 | 9/1953 | United Kingdom | 137/513.3 |

*Primary Examiner*—Robert E. Garrett
*Assistant Examiner*—Thomas Denion

[57] ABSTRACT

An improved hydraulic circuit for automatically sequencing a pair of hydraulic cylinders through alternate extension and retraction cycles. A manually operated control valve initiates addition and withdrawal of fluid within the circuit and a logic valve determines which cylinder will be in communication with the control valve. The circuit uses an improved flow restrictor arrangement for creating the pressure drop which automatically shifts the logic valve. The restrictor consists of an orifice, a simple check valve and a constant pressure relief valve, all arranged in parallel. The functions of these various restrictor elements can all be performed by a single multifunction valve disclosed herein.

8 Claims, 1 Drawing Sheet

Fig. 1
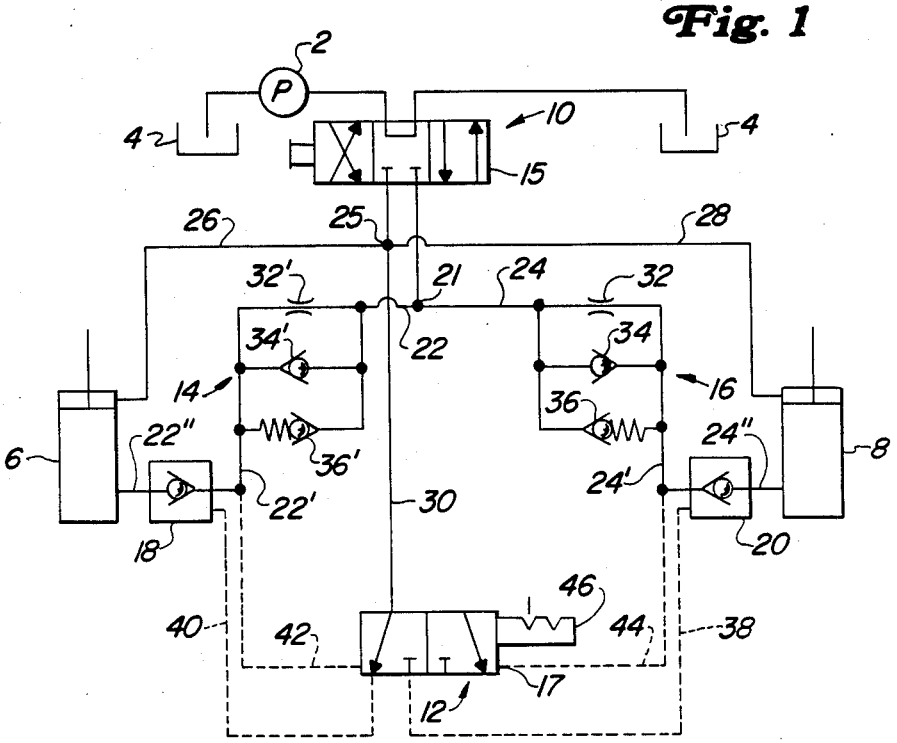
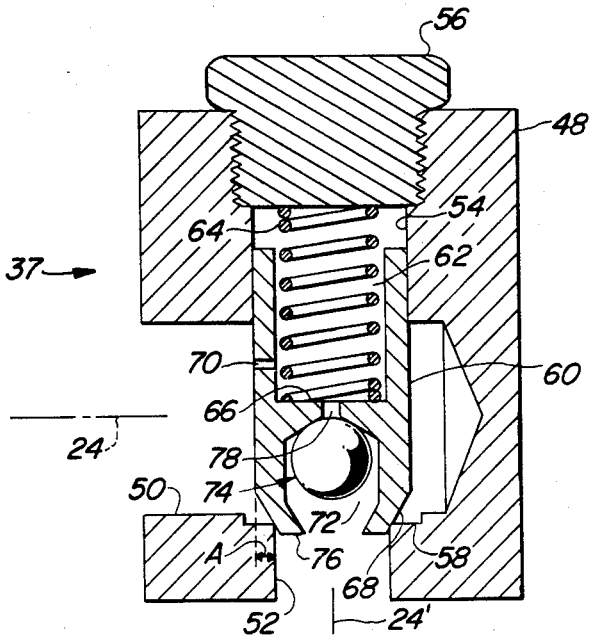
Fig. 2

EXTENSION AND RETRACTION SEQUENCING CIRCUIT

BACKGROUND OF THE INVENTION

1. Field of Invention

This invention relates broadly to hydraulic circuits for sequencing the actuation of hydraulic cylinders. More specifically, this invention relates to a hydraulic circuit for sequentially retracting and extending a pair of hydraulic cylinders.

2. Description of the Prior Art

A variety of operations that are performed by hydraulically powered motors are facilitated by the automatic sequencing of the hydraulic motors. One such application is the operation of row markers for multi-row farm implements. A row marker is used to guide a tractor in successive passes during a planting or cultivating operation. Typically, the row marker projects to the side of the tractor by a distance equal to the width of the implement the tractor is pulling. Thus as the tractor proceeds up the field, it makes a center mark for the succeeding pass. When the tractor comes to the end of a row, the marker in use is raised and a marker extending to the opposite side of the tractor is lowered to again mark the path for the next pass. In order to simplify operation, alternate raising and lowering of both markers is done using a single control having a raised or lowered position. A sequencing circuit automatically lowers and raises each marker sequentially in response to input from the control.

Systems for sequencing the actuation of hydraulic cylinders are well known in the art. A system specifically suited for sequencing row markers is shown in U.S. Pat. No. 4,285,268 issued to Deckler. This patent shows a pair of hydraulic cylinders actuated by a manual control to be raised and lowered sequentially by an automatic sequencing valve. It is commonly practiced in such systems that movement of the automatic sequencing valve is controlled by sensing a pressure difference between the loading lines to each hydraulic cylinder. In order to provide a suitable pressure differential for shifting the valve, the entire flow of fluid for loading the cylinders passes through a flow restrictor. It is difficult to size a simple orifice for the full range of flow rates and oil viscosities that the mechanism may be exposed to during operation. Accordingly, the orifice is either somewhat undersized, thereby slowing down the function of the hydraulic cylinders, or oversized, resulting in improper sequencing at low flow rates. Deckler also exemplifies the common practice of using a spool valve as the load holding device for the hydraulic cylinders, which increases the susceptibility of such a system to leak down.

Accordingly, it is an object of this invention to provide a hydraulic sequencing circuit that will provide quick response and proper sequencing over a wide range of operating conditions.

It is a further object of this invention to provide a hydraulic sequencing circuit that minimizes the possibility of leak down from the load holding elements.

It is yet a further object of this invention to provide a valve for a hydraulic sequencing circuit that will provide the restriction function necessary for proper operation.

SUMMARY OF THE INVENTION

Accordingly, this invention is directed to a hydraulic circuit for automatically alternating actuation of a pair of double-acting hydraulic cylinders so that each cylinder completes an extension and retraction cycle before the next cylinder is actuated. Fluid for the loading cycle is directed to each hydraulic cylinder through a flow restrictor and a signal responsive means for blocking fluid flow out of the cylinder. A logic valve provides a fluid signal for opening the means for blocking fluid flow from the cylinders. The flow restrictors are designed to limit the differential pressure created by the restriction when loading the cylinders while providing adequate pressure drop for operation of the sequencing valve. In one embodiment, the signal responsive means comprise check valves for positively controlling the release of fluid from the cylinders and minimizing the possibility of leak down.

The flow restrictor function is provided in one embodiment by a multifunction restrictor valve containing an orifice and a check valve in a spring biased and pressure responsive spool section.

Other objects, advantages and embodiments of this invention may be obtained from the detailed description that follows.

BRIEF DESCRIPTION OF THE DRAWING

FIG. 1 is a schematic representation of the hydraulic circuit of this invention.

FIG. 2 shows a specific configuration of the restrictor valve.

DESCRIPTION OF THE PREFERRED EMBODIMENT

Looking then at the hydraulic circuit of FIG. 1, there are disclosed working elements and control elements. The working elements consist of a pump 2 and its reservoir 4, and a pair of double-acting hydraulic cylinders 6 and 8. Circuit control is performed by a four-way control valve 10, a three-way logic valve 12, a pair of flow restrictors 14 and 16, and a pair of pilot opening check valves 18 and 20. In order to simplify the description, right- and left-hand nomenclature will be used to describe symmetrical components such as the restrictors, check valves and hydraulic cylinders.

Four-way control valve 10 is manually controlled and has first and third positions for communicating the pump and the reservoir with the rest of the circuit and a second position communicating the pump with the reservoir and preventing fluid flow into or out of the rest of the circuit. In the first position, the extension position, a spool 15 of control valve 10 is shifted rightward and fluid from pump 2 is directed to a connection point 21 for a pair of loading passages 22 and 24. Loading passage 22 communicates with the piston end of hydraulic cylinder 6 via passages 22' and 22'', and loading passage 24 communicates with the piston end of hydraulic cylinder 8 via passages 24' and 24''. In the first position, valve 10 also communicates reservoir 4 with a second connection point 25. Point 25 connects the rod end of cylinder 6, the rod end of cylinder 8 and logic valve 12 through passages 26, 28 and 30, respectively. In the third or retracting position, spool 15 is shifted to the left, the flow connections are reversed and pump 2 directs fluid to connection point 25 while connection point 21 communicates with reservoir 4. In the second or neutral position, all fluid flow through the pump is directed to the reservoir and all flow to or from connection points 21 and 25 is blocked. This second position or neutral position allows the operator to stop and hold the markers in a given position and also provides a position for initial startup wherein marker movement cannot occur.

Restrictors 14 and 16 join passages 22 and 22', and 24 and 24', respectively. These restrictors can be of any type designed to provide a substantially constant pressure drop for fluid flow in a direction from connection point 21 to the hydraulic cylinders. FIG. 1 shows identical configurations for restrictors 14 and 16. Restrictor 16 has arranged in parallel an orifice 32, a simple check valve 34 and a pressure relief valve 36 for maintaining a constant pressure drop across orifice 32. Valve 36 can consist of any type of valve that will completely restrict flow in one direction and maintain a constant pressure drop in an opposite direction.

In FIG. 2, a specific valve configuration 37 is shown to serve the schematically represented function of restrictors 14 and 16. The valve is shown positioned across line 24 and can serve the function of restrictor 16. Valve 37 has a valve body 48 containing a blind bore 50 which is in direct communication with passage 24. A stepped through bore made up of small and large diameter bore sections 52 and 54, respectively, crosses bore 50 at a right angle. Bore section 52 is in direct communication with passage 24'. Threads at one end of larer bore section 54 engage a cap 56 to seal the end of the stepped bore opposite section 52. The larger bore section 54 maintains its diameter across bore 50 to define a shoulder 58 at the adjacent end of section 52. A movable spool section 60 sealingly engages the walls of bore section 54. Spring cavity 62 within spool 60 holds a spring 64. Spring 64 acts against the bottom 66 of cavity 62 and the inner face of the cap 56 to push angled face 68 of the spool onto the edge of shoulder 58. An orifice passage 70 extends radially through spool 62 and constantly communicates bore 50 with cavity 62. A check ball cavity 72 at the front end of spool 62 houses a check ball 74. A set of prongs 76 retain check ball 74 in the cavity while allowing open communication between the cavity and bore section 52. An internal spool valve passage 78 permits fluid communication from the spring cavity to the check ball cavity. The bottom end of passage 78 acts as a valve seat for check ball 74 to prevent fluid flow into the valve cavity 62 through passage 78.

Also positioned along passages 22' and 22'', and 24' and 24'' are connected across pilot opening check valves 18 and 20, respectively. These check valves permit fluid flow to the hydraulic cylinders at all times and prevent fluid flow away from the hydraulic cylinder until opened by a fluid signal. Fluid signals for opening check valves 20 and 18 flow through pilot passages 38 and 40, respectively.

Logic valve 12 is a three-way control valve shiftable between two positions. In the first position, the spool 17 of the control valve is shifted rightward and connects passage 30 with pilot passage 40 while spool 17 blocks fluid flow out of passage 38. In the second position, spool 17 is shifted leftward and connects pilot passage 38 with passage 30 while spool 17 blocks fluid flow to passage 40. Spool 17 is shifted rightward in response to the pressure in passage 42 being higher than the pressure in passage 44 and leftward in response to pressure in passage 44 exceeding pressure in passage 42. Line pressure communicated through passages 42 and 44 respectively is sensed between the flow restrictors and pilot opening check valves at passage sections 22' and 24'. Therefore, the sequencing valve 12 is responsive to differential pressure between passage sections 22' and 24'. In order to prevent unwanted movement or hunting of the valve under low differential pressure conditions, a detent 46 maintains the valve in a given position until an adequate directional force develops.

OPERATION

With the basic elements and their interconnection explained, a more thorough understanding of the invention can be obtained by following the operation of the circuit through a complete cycle. In the case of a farm implement, a complete cycle could be divided into four parts consisting of the retracting and extension of the hydraulic cylinder on one side to effect the lowering and raising of a row marker followed by retracting and extension on the opposite side to move an opposing row marker down and up.

Starting then from the condition wherein both cylinders are extended as shown in the FIG. 1, i.e., both markers would be in the raised condition, spool 15 will be moved manually from the position shown to the left to retract the cylinder which is next in the sequence to be lowered. Shifting of spool 15 leftward causes fluid pressure to be communicated to the rod ends of cylinders 6 and 8 and to logic valve 12. Rightward positioning of spool 17 in a previous cycle has communicated fluid pressure from passage 30 across valve 12 to signal passage 40. Pressure in signal passage 40 opens check valve 18 so that fluid flows freely across check valve 34' and ultimately to reservoir 4, retracting hydraulic cylinder 6. Although fluid also flows across the orifice 32', most of the fluid flows across check valve 34'; thus, a suitable restrictor arrangement need not provide fluid flow across the orifice when the cylinder retracts. On the opposite side, hydraulic cylinder 8 remains extended since fluid pressure is maintained at the piston end of the cylinder by check valve 20. During the retraction of cylinder 6, pressure in line 42 equals or exceeds pressure in line 44 so that spool 17 remains shifted to the right.

In the next quarter of the cycle, spool 15 is manually shifted rightward through the neutral position, as shown in the FIG. 1, to the first position which will extend the hydraulic cylinders by communicating fluid from pump 2 across control valve 10 to connection point 21. Since hydraulic cylinder 8 is already extended, fluid flows only from connection point 21 to cylinder 6. Fluid enroute to cylinder 6 flows first across restrictor 14. As fluid passes through orifice 32', and the pressure drop across orifice 32' increases, pressure responsive check valve 36' will open to allow a greater volumetric flow rate to hydraulic cylinder 6. Nevertheless, a minimum pressure drop, equal to the pressure required to open pressure responsive check valve 36', will be maintained across restrictor 14. Fluid leaves hydraulic cylinder 6 through passage 26 until the piston and rod are moved fully upward and the cylinder is fully extended. As stated, cylinder 8 is fully extended or in a raised position at the start of this cycle; therefore, no fluid will flow across passage 24 and essentially the full line pressure at point 21 is instantaneously achieved at passage section 24'. Line 44 therefore communicates a higher pressure than line 42 to the control valve while cylinder 6 is being extended and causes a net leftward force on logic valve 12. This force overcomes the resistance of detent 46 and causes the spool valve 17 to shift leftward in preparation for the remaining half of the cycle.

The third quarter of the cycle is started by shifting spool 15 leftward back through the neutral position to the retraction position. Because spool 17 was moved leftward in the previous quarter cycle, check valve 18 remains closed preventing retraction of hydraulic cylinder 6 and fluid pressure is commnicated from pump 2 via valve 10, passage 30, and passage 38 to open check valve 20. With valve 20 open, fluid pressure in line 28 acts to retract hydraulic cylinder 8 in the manner previously described for hydraulic cylinder 6.

In order to complete the cycle, spool 15 is shifted back through the neutral position to the right into the extending position so that pressurized fluid extends cylinder 8 and creates a pressure drop between passage sections 22' and 24' in a manner analogous to that previously explained. The pressure difference communicated via passages 42 and 44 now causes spool 17 to shift to the right and the cycle is ready to begin again upon shifting of spool 15.

When valve 15 is moved to the neutral position, pressure supplied to pilot passage 38 or 40 via passage 30 and valve 12 is interrupted. As a result, both pilot opened valves 12, 18 close, holding the loads in position until valve 15 is activated to raise or lower the load.

The function of restrictors 14 or 16 is conveniently provided by the restrictor valve 37. The operation of the restrictor valve can be more fully appreciated by looking first at what happens when fluid flows from passage 24 to 24' and spool 60 has its face 68 initially seated against shoulder 58. At this stage, the valve functions as a simple orifice with all fluid from passage 24 to 24' passing through orifice 70 and past check ball 74. As the pressure drop across the orifice increases, the pressure differential between passage 24 and 24' acts over an annular area of the spool until the spool face 68 rises off shoulder 58, thereby providing a large flow area between passages 24 and 24'. The annular area has a width from the outside of the spool indicated in FIG. 2 by the letter A. Spring 64 is selected in relation to annular area A to provide a spring force that will allow unseating of the spool at a predetermined pressure and has a low spring constant so that the pressure drop is relatively uniform. When fluid flow is directed from passage 24' to 24, check ball 74 seats against the bottom passage 78 blocking fluid flow through the valve cavity 62 and orifice 70. As a result, the full pressure differential between passages 24' and 24 acts over the area of bore 52 to unseat the spool valve. The area of bore 52 is set such that only a minimal pressure drop is needed to overcome the force of spring 62 and the restrictor valve opens like an ordinary check valve.

Although this invention has been described in the context of specific embodiments, this presentation is not meant to limit the invention to the particular details disclosed herein.

What is claimed:

1. A multifunction valve comprising:

a valve body having first and second intersecting bores, said first bore being closed at one end, said second bore being a stepped bore closed at the end of the large diameter section, the step portion providing a valve seat about the periphery of the small diameter section;

a valve spool slidably disposed within and engaging the walls of said large diameter bore section, having a valve face for sealingly contacting said valve seat;

means for biasing said spool toward said valve seat;

a flow limiting orifice passage communicating said first bore with the large diameter section of said second bore;

a check valve passage communicating both sections of said stepped bore on opposite sides of said spool, said check valve passage having a check element for blocking fluid flow from said small section to said large section.

2. The multifunction valve of claim 1 wherein said orifice passage and check valve passage extend through said spool.

3. The multi-function valve of claim 1 wherein said valve spool further comprises one end surface exposed to the fluid pressure in said large diameter bore section of said second bore and another end surface at least part of which is exposed to the fluid pressure in said first bore.

4. A multifunction valve comprising:

a valve body having first and second intersecting bores, said first bore being a blind bore, said second bore being a stepped bore closed at the end of the large diameter section and said step portion providing a valve seat about the periphery of said small diameter section;

a valve spool slidably disposed within the walls of said large diameter section, said spool having a diameter sufficient to sealingly engage the walls of said large diameter section, an angled face portion for sealingly contacting said valve seat, an internal bore open at one end of said large diameter section, an internal cavity axially adjacent to said internal bore and open to said small diameter section, a passage connecting said cavity and said internal bore, and an orifice defined by the wall of said spool between said internal bore and said first bore;

a spring acting against the bottom of said internal bore and the end of said large diameter section to urge said angled face into sealing contact with said valve seat; and a check element retained in said cavity to sealingly engage the opening of said cavity and internal bore interconnecting passage and block fluid flow from said small diameter section to said internal bore.

5. The multi-function valve of claim 4 wherein said angled face portion of said valve spool is at least partially exposed to the pressure in said first bore and wherein said valve spool further comprises an end face exposed to the pressure in said large diameter section of said second bore.

6. In a hydraulic circuit for automatically alternating actuation of a pair of double-acting hydraulic cylinders such that upon repeated actuation each cylinder sequentially completes an extension and retraction cycle, said circuit comprising:

a source of pressurized fluid;

a fluid reservoir;

a pair of hydraulic cylinders each having first and second ports;

a first pair of passages, each passage connecting a first port of one of said cylinders with a first fluid connection point;

a pilot opening check valve in each of said first passages blocking fluid flow from said first port;

a second pair of passages, each passage connecting one of said second ports with a second fluid connection point;

a three-way, two-position control valve having first and second positions for alternately communicating fluid pressure from said second connection to one of said pilot opening check valves;

first and second pilot means for shifting the control valve to its first and second positions, each of said pilot means being responsive to fluid pressure in a section of a different one of said first passages; and means for alternatively communicating said first and second connection points with said pressurized fluid source and said reservoir;

the improvement comprising:

a flow restrictor in each of said first passages between said first connection point and said check valve, each said restrictor comprising a multifunction valve including:

a valve body having a first and second intersecting bores, said first bore being a blind bore open at one end to said first connection point, said second bore being a stepped bore closed at the end of the large diameter section and open to a first port of one of said cylinders at the end of the small diameter section, said step portion providing a valve seat about the periphery of said small diameter section;

a valve spool slidably disposed within and engaging the walls of said large diameter bore section, having a valve face for sealingly contacting said valve seat;

means for biasing said spool toward said valve seat;

an orifice passage communicating said first bore with the large diameter section of said second bore;

a check valve and a check valve passage communicating both sections of said stepped bore on opposite sides of said spool, said check valve blocking fluid flow from said small section to said large section.

7. The hydraulic circuit of claim 6 wherein said valve spool further comprises one end exposed to the pressure in said large diameter section of said second bore and another end at least part of which is exposed to the pressure in said first bore.

8. The hydraulic circuit of claim 6 wherein said orifice passage and check valve passage extend through said spool.

* * * * *

UNITED STATES PATENT AND TRADEMARK OFFICE

CERTIFICATE OF CORRECTION

PATENT NO. : 4,821,622

DATED : 18 April 1989

INVENTOR(S) : Ronnie Franklin Burk

It is certified that error appears in the above-identified patent and that said Letters Patent is hereby corrected as shown below:

In column 6, line 30, delete "of" and insert therefor -- to --.

In column 7, line 17, delete "a". (second occurrence)

Signed and Sealed this

Twelfth Day of March, 1991

*Attest:*

HARRY F. MANBECK, JR.

*Attesting Officer*

*Commissioner of Patents and Trademarks*